United States Patent [19]

Ito

[11] Patent Number: 4,815,200

[45] Date of Patent: Mar. 28, 1989

[54] METHOD FOR IMPROVING ACCURACY OF CONNECTIONS TO ELECTRICAL TERMINAL

[75] Inventor: Yukio Ito, Aichi, Japan

[73] Assignee: Yazaki Corporation, Tokyo, Japan

[21] Appl. No.: 126,100

[22] Filed: Nov. 30, 1987

[51] Int. Cl.[4] ..... H01R 43/00

[52] U.S. Cl. ..... 29/857; 29/863; 29/874; 29/884; 439/877; 439/884

[58] Field of Search ..... 29/857, 861, 863, 867, 29/874, 884; 439/877, 882, 884, 885

[56] References Cited

U.S. PATENT DOCUMENTS 3,239,918 3/1966 Cobaugh ..... 29/867

3,668,764 6/1972 Randar ..... 29/867

*Primary Examiner*—Timothy V. Eley

*Assistant Examiner*—Taylor J. Ross

*Attorney, Agent, or Firm*—Sughrue, Mion, Zinn, Macpeak, and Seas

[57] ABSTRACT

A method is disclosed for improving both the accuracy of severing electrical terminals from the chains in which they are supplied and the alignment between the terminal and the lead wire which is attached to the terminal. In both cases, alignment marks are formed on the terminal at locations delimiting the maximum ranges of positions for respective transitional edges of the cutting die used to separate the terminals and the insulation-stripped end of the lead wire. The terminal is aligned with the die and the lead wire using these marks prior to cutting and crimping of the wire.

14 Claims, 4 Drawing Sheets

METHOD FOR IMPROVING ACCURACY OF CONNECTIONS TO ELECTRICAL TERMINAL

BACKGROUND OF THE INVENTION

The present invention relates to a method for improving the accuracy of connection made between a lead wire and a slip-on type electrical terminal to which the lead wire is permanently attached.

A terminal of a type to which the invention can be applied is illustrated in FIG. 1 of the attached drawings. The terminal has a slip-on contact portion a and an electrical wire securing portion including conductor-crimping tabs b and insulation-crimping tabs c. In accordance with the conventional method, to attach a lead wire to the terminal, the insulation d is stripped from the wire by a predetermined length to bare the conductor e. The end of the wire so prepared is placed between the tabs b and c and the tabs b and c bent over to fix the wire to the terminal.

However, if the length of the exposed conductor e is too long or too short, the positional relationship between the terminal and the wire may not be proper. If, for example, the length of the exposed conductor e is too long or the end of the wire is positioned too far forwardly in the terminal, as shown in FIG. 2, the end of the conductor has a tendency to fray, potentially causing the terminal when installed to be short-circuited to another member. Also, inaccuracies in stripping the insulation d and aligning the end of the wire with the terminal can result in a portion of the insulation d being clamped by the conductor-crimping tabs b, as illustrated in FIG. 3, resulting in a poor connection between the wire and the terminal.

A further difficulty to which the invention is addressed relates to the manner in which the terminals are severed from the chain in which they are supplied and transported to the machine which attaches the wires to the terminals. That is, these terminals are ordinarily supplied in the form of a long chain, with the terminals either arranged serially, as shown in FIG. 4 where the terminals A are connected end to end via coupling segments B, or in parallel form, as shown in FIG. 5 where the terminals A are coupled on both sides via linear coupling segments C and C'. Just before the terminals are moved to the position where the leads wires are attached, the coupling segments B or C and C' are severed.

If, however, the remaining portion of a coupler segment on either end of the terminal after the severing operation is too long, the remaining portion may in use come into contact with another member, thereby short-circuiting the terminal. Also, the insulation of the lead wire can be damaged if the remaining portion of the coupler segment at the rear (lead wire end) of the terminal is too long. On the other hand, if, for instance, the coupler segment at the front end of the terminal is cut off too short, damage to the contact portion of the terminal may occur.

SUMMARY OF THE INVENTION

The present invention is intended to solve the above-discussed problems.

Accordingly, one object of the invention is to provide a method for attaching a lead wire to a terminal with which the lead wire can readily be properly positioned at all times.

Another object of the invention is to provide a method for severing terminals from the chain in which they are supplied with which it is ensured that the proper lengths of the coupler segments will always be cut off.

In accordance with the above and other objects, the invention provides a method for processing an electrical terminal, comprising steps of providing first and second sets of alignment marks on at least one surface of the terminal, and relatively positioning the terminal such that first and second transition points on a body with which the terminal is to be aligned are located between ones of the marks of the first and second sets of alignment marks, respectively. In one example of the practice of the invention, the body is the end of a lead wire to be attached to the terminal and from which a predetermined length of insulation has been stripped to expose a portion of a conductor of the lead wire, and the first and second transition points are a tip of the conductor and an end of the insulation. In another example, the body is a cutting die used to sever terminals from a chain of terminals, the surface of the terminal is a surface of a coupling member between a contact portion of one terminal and an insulation-crimping portion of an adjacent terminal, and the first and second transition points are opposing sides of the cutting die.

DESCRIPTION OF THE PREFERRED EMBODIMENTS

Figure 1:
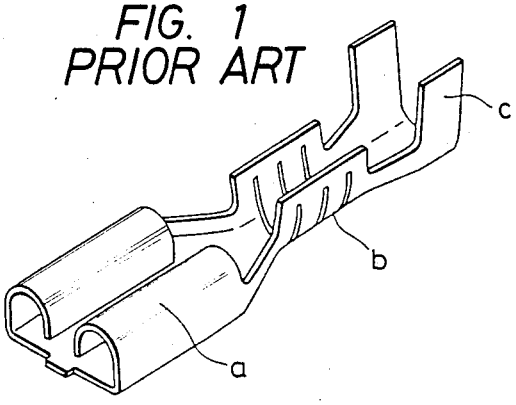
FIG. 1 PRIOR ART
FIG. 1 is a perspective view of a conventional terminal.
Figure 2:
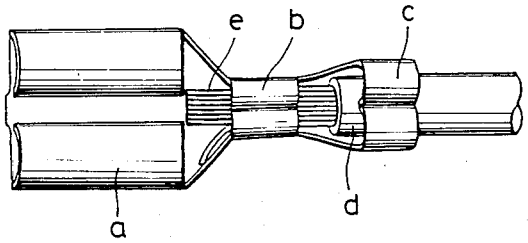
FIG. 2 PRIOR ART
FIG. 2 is a plan view of the conventional terminal with a wire attached having too long an exposed conductor portion.
Figure 3:
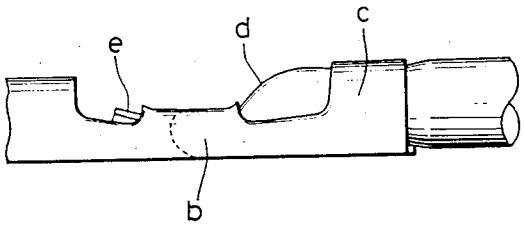
FIG. 3 PRIOR ART
FIG. 3 is a front view of the conventional terminal having too short an exposed conductor portion.
Figure 4:
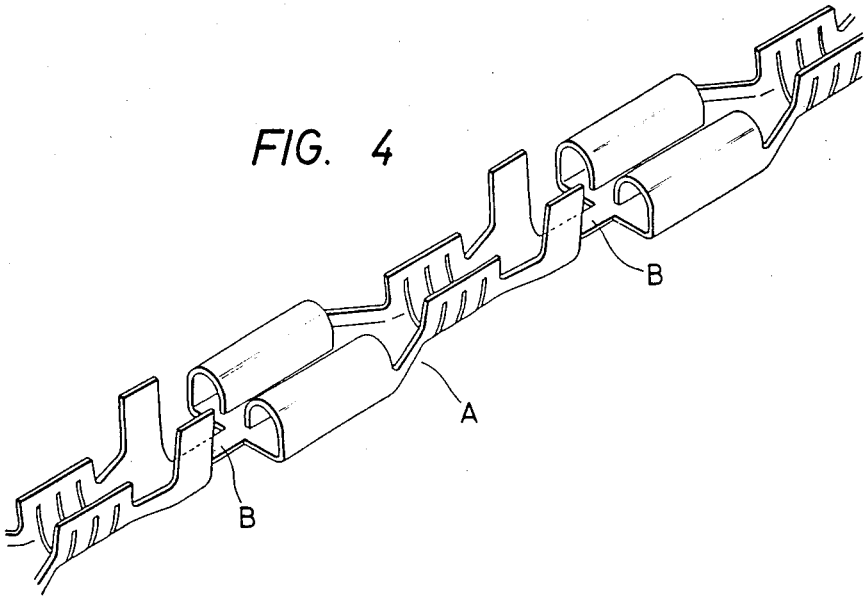
FIG. 4 is a perspective view of terminals supplied in a serial chain.
Figure 5:
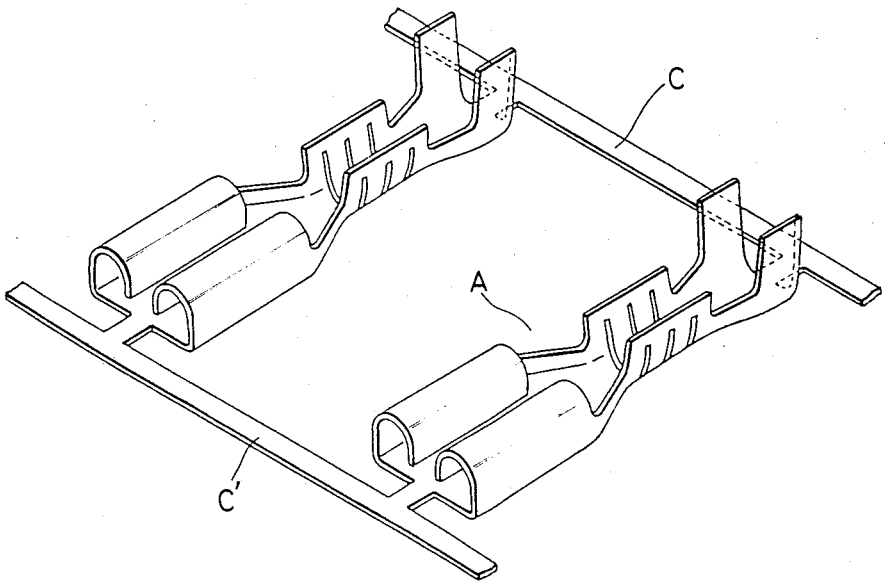
FIG. 5 is a perspective view of terminals supplied in a parallel chain.
Figure 6A:
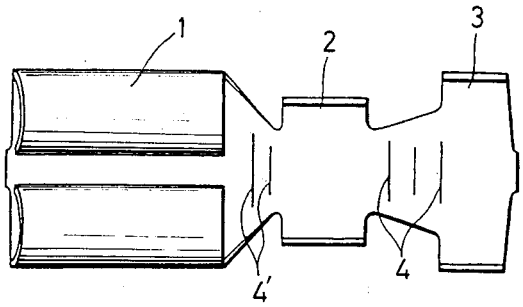
FIG. 6A is a plan view of a terminal used in the practice of a first preferred embodiment of the invention.
Figure 6B:
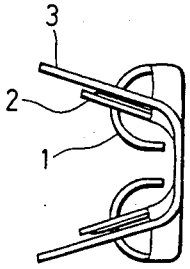
FIG. 6B is a plan view showing the terminal of FIG. 6A with a lead wire properly attached.

Preferred embodiments of the invention will now be described with reference to the attached drawings. Reference numerals and characters indicate like elements throughout.

Figure 10:
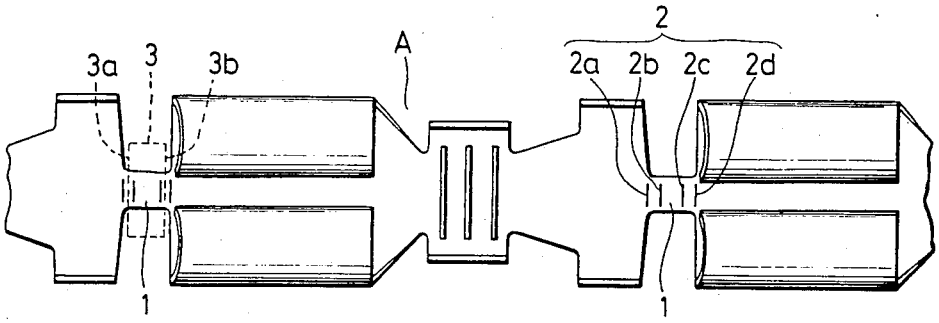
FIG. 10 is a plan view of a chain of terminals used in the practice of a further embodiment of the invention.

Reference will first be made to FIG. 10. As illustrated in FIG. 10, in accordance with one aspect of the present invention, three impressed lines 4 are provided on the terminal between insulation-crimping tabs 3 and conductor-crimping tabs 2. The impressed lines 4 are indicative of the front limit, center and rear limit of the position of the end of the insulation on the lead wire to be attached to the terminal. A second set of impressed lines 4, are provided between the contact portion 1 of the terminal and the conductor-crimping tabs 2. The impressed lines 4, are indicative of the front and rear limits for the position of the tip of the conductor of the lead wire.

To secure the wire to the terminal, in accordance with the present invention, after stripping the insulation to a designated length, the tip of the conductor 8 of the lead wire is placed between the two impressed lines 4', and the end of the insulation is aligned with the center one of the three impressed lines 4. As a result, the conductor will always be secured in proper positional relationship with respect to the terminal, and both the insulation and the conductor will be clamped by their respective tabs 3 and 2 at the correct position. Of course, if this alignment cannot be achieved due to an incorrect length of insulation having been stripped from the wire, the end of the wire can be trimmed or the wire cut off and the insulation stripped again to achieve the proper length, and the alignment process repeated.

The lines 4 and 4' can be impressed into the metal of the terminal at the same time that the terminal is formed from the sheet of starting material by pressing or the like.

Figure 8:
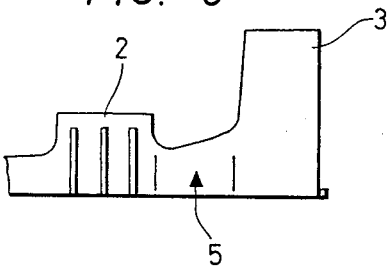
FIG. 8 is a partially cut-away side view of a terminal used in another embodiment of the present invention.
Figure 9:
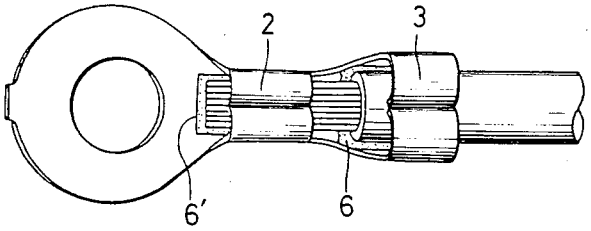
FIG. 9 is a plan view of a terminal used in still another embodiment of the present invention.

Although the lines 4 and 4' are shown as being provided on the inside surface of the terminal in the above-described embodiment, it is possible to form them on the outer surface of the terminal, as shown in FIG. 8. Also, the lines 4 and 4' may be replaced with colored bands, as illustrated in FIG. 9.

Figure 11:
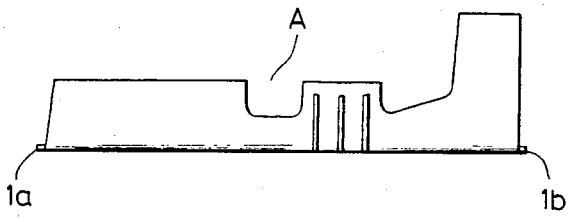
FIG. 11 is a partially cut-away side view of a terminal cut off from the chain in accordance with the inventive method.

Further embodiments of the invention will be described with reference to FIGS. 10 to 12.

FIG. 10 shows a chain of serially connected terminals. In accordance with the invention, front and rear portions of terminals A are connected via coupling segments 11. In accordance with the invention, each coupling segment 11 is provided with four mark lines 12 (12*a* to 12*d*) impressed on the surface of the coupling segments. The lines 12 can be formed in the manner described above, and they may be formed simultaneously with the formation of the chain of terminals using a pressing technique, as already described. All four marks 12 are parallel with one another. The marks 12*a* and 12*d* indicate outside limits for cutting, while the marks 12*b* and 12*c* indicate inside limits.

To sever the terminals from the chain, the terminals are fed one by one past a cutting die 13. The chain is set so that the two side edges 13*a* and 13*b* of the cutting die 13 are aligned between respective pairs 12*a*, 12*b* and 12*c*, 12*d* of the lines 12, and only then is the cutting die pressed against the coupler segment to sever the terminal from the chain. As a result, the lengths of the remaining portions of the coupler segments, illustrated in FIG. 11, will always be within predetermined limits.

Figure 7:
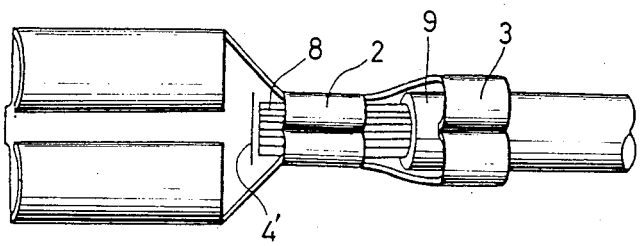
FIG. 7 is a plan view of a terminal attached to a wire in accordance with the method of the present invention.
Figure 12:
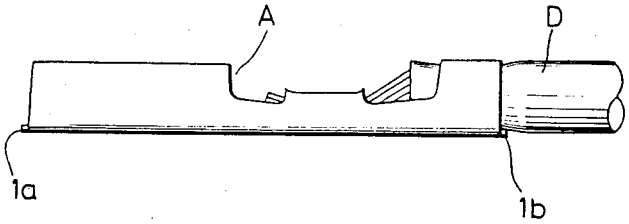
FIG. 12 is a side view of a terminal and wire properly connected together in accordance with the invention.

When the terminal is severed from the chain and the lead wire attached according to the inventive method, proper attachment of the lead wire to the terminal, as illustrated in FIGS. 7 and 12, will always be achieved. That is, with the use of the invention, the possibility of short circuiting of the terminal due to an improperly attached lead wire is eliminated.

Another advantage is that the terminal with the lead wire attached can easily be visually inspected.

As previously described, other positions of the marks 12 can be employed, and the marks can be formed by techniques other than pressing, for example, printing, plating, with the use of color bands, and the like.

This completes the description of the preferred embodiments of the invention. Although preferred embodiments have been described, it is believed that numerous alterations and modifications thereto would be apparent to one of ordinary skill in the art without departing from the spirit and scope of the invention.

What is claimed is:

1. A method for processing an electrical terminal, comprising the steps of:

providing first and second sets of alignment marks on at least one surface of said terminal; and relatively positioning said terminal such that first and second transition points on a body with which said terminal is to be aligned are located between ones of said marks of said first and second sets of alignment marks, respectively.

2. The method of claim 1, wherein said body is the end of a lead wire to be attached to said terminal and from which a predetermined length of insulation has been stripped to expose a portion of a conductor of said lead wire, and wherein said first and second transition points are a tip of said conductor and an end of said insulation.

3. The method of claim 1, wherein said body is a cutting die used to sever terminals from a chain of terminals, wherein said surface of said terminal comprises a surface of a coupling member between a contact portion of one terminal and an insulation-crimping portion of an adjacent terminal, and wherein said first and second transition points are opposing sides of said cutting die.

4. A method for aligning the end portion of a lead wire with a terminal prior to crimping said terminal to said lead wire, comprising the steps of:

providing first and second sets of alignment marks on a surface of said terminal, said first set comprising at least two marks located between a contact portion and a pair of conductor-crimping tabs of said terminal, and said second set comprising at least two marks located between said conductor-crimping tabs and a pair of insulation-crimping tabs of said terminal;

stripping a predetermined length of insulation from an end portion of a lead wire to be attached to said terminal to expose a portion of a conductor of said lead wire;

placing said lead wire on said terminal such that a tip of said conductor is located between said two marks of said first set and an end of remaining insulation on said wire is located between said two marks of said second set; and crimping both said sets of tabs to fix said wire to said terminal.

5. The method of claim 4, wherein said second set of marks comprises three marks, two end marks and a center mark, and wherein, in said step of placing said lead wire on said terminal, said end of said insulation is aligned with said center mark.

6. The method of claim 4, wherein all said marks are formed by pressing simultaneously with formation of said terminals.

7. The method of claim 4, wherein said marks comprise edges of colored bands extending between said marks of each said sets of marks.

8. The method of claim 4, wherein said marks are formed on a front surface of said terminal.

9. The method of claim 4, wherein said marks are formed on a rear surface of said terminal.

10. A method for severing terminals from a chain of terminals in which adjacent terminals are connected through at least one coupler segment, comprising the step of:

providing at least first and second sets of alignment marks on each of said coupler portions, each of said sets corresponding to limit positions of a corresponding edge of a cutting die;

positioning said terminal relative to said cutting die such that opposing edges of said cutting die are located between the marks of said first and second sets; and lowering said cutting die to sever said terminal from said chain.

11. The method of claim 10, wherein all said marks are formed by pressing simultaneously with formation of said terminals.

12. The method of claim 10, wherein said marks comprise edges of colored bands extending between said marks of each said sets of marks.

13. The method of claim 10, wherein said marks are formed on a front surface of said terminal.

14. The method of claim 10, wherein said marks are formed on a rear surface of said terminal.

* * * * *